US005577564A

United States Patent [19]

Le

[11] Patent Number: 5,577,564

[45] Date of Patent: Nov. 26, 1996

[54] ROTARY FLUID CONVERTER

[75] Inventor: Tuong T. Le, Houston, Tex.

[73] Assignee: Dresser Industries, Inc., Dallas, Tex.

[21] Appl. No.: 396,382

[22] Filed: Feb. 28, 1995

[51] Int. Cl.[6] ..... E21B 4/00

[52] U.S. Cl. ..... 175/93; 175/107

[58] Field of Search ..... 175/93, 107, 324

[56] References Cited

U.S. PATENT DOCUMENTS

| | | | |
|---|---|---|---|
| 3,260,318 | 7/1966 | Neilson et al. | 175/75 |
| 3,318,397 | 5/1967 | Combes | 175/73 |
| 3,456,746 | 7/1969 | Garrison et al. | 175/320 |
| 3,489,231 | 1/1970 | Garrison et al. | 175/323 |
| 3,609,071 | 9/1971 | Brown | 418/221 |
| 3,782,867 | 1/1974 | Gerlach et al. | 418/82 |
| 3,879,094 | 4/1975 | Tschirky et al. | 308/230 |
| 3,936,247 | 2/1976 | Tschirky et al. | 175/107 X |
| 3,982,859 | 9/1976 | Tschirky et al. | 175/107 X |
| 4,029,368 | 6/1977 | Tschirky et al. | 175/371 |
| 4,114,703 | 9/1978 | Matson, et al. | 175/107 |
| 4,260,031 | 4/1981 | Jackson, Jr. | 175/107 |
| 4,324,299 | 4/1982 | Nagel | 175/107 |
| 4,327,597 | 5/1982 | Soto | 74/434 X |
| 4,476,944 | 10/1984 | Beimbraben | 175/107 X |
| 4,493,381 | 1/1985 | Kajikawa et al. | 175/107 |
| 4,501,454 | 2/1985 | Dennis et al. | 384/619 |
| 4,546,836 | 10/1985 | Dennis et al. | 175/107 |
| 4,560,014 | 12/1985 | Geczy | 175/107 |
| 4,577,704 | 3/1986 | Aumann | 175/107 |
| 4,819,745 | 4/1989 | Walter | 175/107 |
| 4,867,042 | 9/1989 | Kita | 92/58 |
| 5,048,981 | 9/1991 | Ide | 175/107 X |
| 5,246,080 | 9/1993 | Horvei et al. | 175/93 |
| 5,385,407 | 1/1995 | De Lucia | 175/107 |

*Primary Examiner*—Roger J. Schoeppel

*Attorney, Agent, or Firm*—Jones, Day, Reavis & Pogue

[57] ABSTRACT

A rotary fluid converter having sloping exterior shoulders at one end, a hollow bore at the center, and a downwardly sloping fluid orifice extending from said sloping exterior shoulders at a tangent to said interior bore such that turbulence caused by said fluid flow is reduced thereby reducing the erosion and wear of said rotary fluid converter.

4 Claims, 1 Drawing Sheet

ROTARY FLUID CONVERTER

BACKGROUND OF THE INVENTION

1. Field of the Invention

The present invention relates in general to the art of bearing assemblies and in particular to an improved bearing section for a downhole drilling motor that is carried near the end of a rotary drill string and actuated by the down-flowing drilling fluid to drive a rotary bit for the drilling of oil and gas wells and the like.

2. Description of Related Art

The conventional U.S. system of oil well drilling involves the rotation of a string of drill pipe with a rotary drill bit located at the end of the drill string. Power from a motor or engine at the surface is transmitted to the bit by rotating the entire drill string. During drilling, a drilling fluid, generally called drilling mud, is pumped downward through the inside of the drill string and out through ports in the drill bit. The fluid then carries the material loosened by the drill bit back to the surface through the annular space between the drill pipe and bore hole. Many and varied circumstances make it desirable to drive the drill bit at speeds independent of the rotation of the drill string.

A downhole motor is usually attached at or near the bottom of the drill string to accomplish such independent rotation of the drill bit. The motor may be electric or hydraulic. If hydraulic, it may be either a turbine or a positive displacement vane loader or it may be other types. All motors must have certain essential elements. First is a power section with a stator and a rotor which produce the torque and rotation between them. Next is a bearing section that includes thrust and radial bearing supports between the stationary and rotating members to accommodate thrust forces in both the up and down directions. Finally, there must be a flow path for the drilling fluid from the drill string to the drill bit, which path may be through the power section and at least partially through the bearing supports for lubrication. It will be realized that the drilling fluid and its contaminates are hostile to the function and life of the bearing and, therefore, control of the drilling fluid through the bearing section is significant to motor function, life, and overall drilling cost.

Such a system would require diversion of the drilling fluid flow through the bearing section with minimum erosion. Further, such control of the drilling fluid flow could substantially reduce drilling fluid erosion at the intersection of the lower bearing section and its associated power or drive section. Further, the bearing assembly is so constructed as to reduce thread fatigue breakage due to oscillating load conditions at the intersection of the lower bearing section and its top drive shaft. The bearing assembly is further protected if the drill pipe inner diameter drilling fluid flow is diverted from direct flow through the bearing assembly and yet allow the drilling fluid to serve as the lubrication. Further it is helpful to reduce the hydrostatic pressure applied to the bearing assembly.

The invention disclosed in commonly assigned U.S. Pat. No. 5,385,407 solves the aforementioned problems. It is, however, advantageous to have even further turbulence reduction around the input to the rotary fluid converter and into the bore to improve the life of the tool by further reducing erosion of the tool as a result of fluid turbulence.

Commonly assigned U.S. Pat. No. 5,385,407 identifies U.S. Pat. Nos. 4,546,836, 4,577,704, and 4,114,703 as relevant to the invention.

SUMMARY OF THE INVENTION

Commonly assigned U.S. Pat. No. 5,385,407 issued Jan. 31, 1995 is incorporated by reference in its entirety. The present invention further reduces turbulence around the input to the rotary fluid converter in two ways. First, the shoulders on the upper portion of the rotary fluid converter containing the fluid orifice that couples fluid to the interior bore of the rotary fluid converter are sloped to provide a smoother surface over which the drilling fluid can flow when entering the fluid orifice of the rotary fluid converter, thereby reducing turbulence. Second, the top and bottom walls of the fluid orifice coupling the exterior of the rotary fluid converter to the interior bore are also sloped downwardly thus providing a more direct fluid path to the interior bore with less abrupt transition points over which the drilling fluid must flow when entering the interior bore, thereby reducing turbulence. In the invention disclosed in U.S. Pat. No. 5,385,407, the top and bottom walls of the fluid orifice through which the drilling fluid entered the interior bore were horizontal rather than sloped. As a result, the drilling fluid entering the interior bore of the rotary fluid converter entered at a right angle relative to the direction of the downward flow of the drilling fluid causing turbulence in the drilling fluid.

Thus, it is an object of the present invention to further reduce the abrasion and wear of a rotary fluid converter.

It is also an object of the present invention to cause a first decrease in fluid turbulence by sloping the upper shoulder of the rotary fluid converter in which the fluid orifice is located that conveys fluid from the exterior to the interior of the rotary fluid converter thereby reducing the sharpness of the angles through which the fluid must flow and providing a more direct fluid flow path.

It is still another object of the present invention to cause a second decrease in fluid turbulence in the fluid path by sloping the top and bottom walls of the fluid orifice in a downward direction thus enabling the fluid to flow in a still more direct path from the exterior of the rotary fluid converter to the interior bore thereof.

Thus the present invention relates to an improved hollow elongated rotary converter having sloping exterior shoulders on one end, a hollow bore at the center, and a downwardly sloping fluid orifice in said sloping shoulders to couple the exterior sloping shoulders to the hollow interior bore to reduce the turbulence of the fluid flowing from said exterior of said rotary converter to said bore thereon.

BRIEF DESCRIPTION OF THE DRAWINGS

These and other features of the present invention will be more fully disclosed when taken in conjunction with the following DETAILED DESCRIPTION OF THE DRAWINGS in which like numerals represent like elements and in which.

DETAILED DESCRIPTION OF THE DRAWINGS

Figure 1:
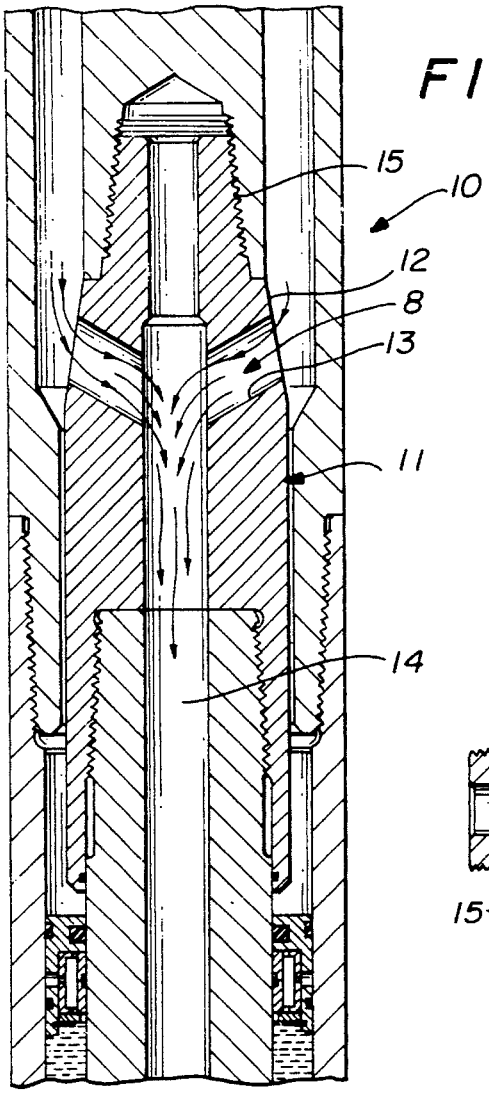
FIG. 1 is a cross-sectional view of a downhole drilling motor within which is placed the novel rotary fluid converter of the present invention.

Referring now to the drawings and to FIG. 1 in particular, a cross-sectional view of a downhole drilling motor is illustrated and generally designated by the reference numeral 10. Inside of this downhole drilling motor 10 is the novel rotary fluid converter 11 of the present invention. The rotary fluid converter 11 has a sloped shoulder 12 which causes a first reduced turbulence created by the drilling fluid when entering the rotary fluid converter 11. The sloped shoulders 12 are at an angle less than 90° relative to the longitudinal axis of bore 14. The rotary fluid converter 11 also has a fluid orifice 8 with downwardly sloped top and bottom walls 13 that engages bore 14 at a tangent as shown in commonly assigned U.S. Pat. No. 5,345,407 and further reduces the turbulence created by the drilling fluid when flowing into the bore (or hollow interior) 14 of the rotary fluid converter 11.

Figure 2:
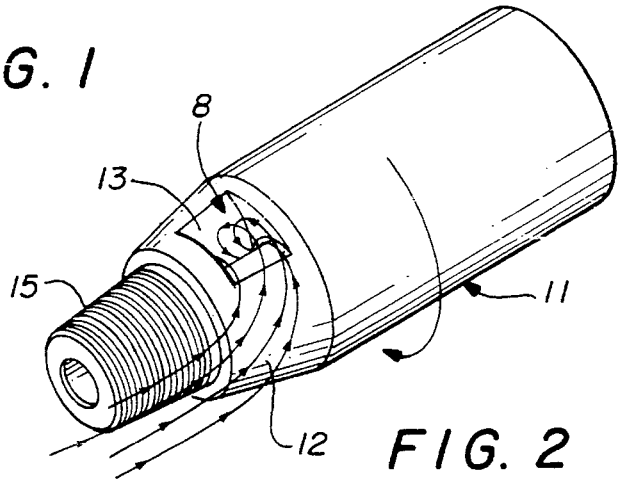
FIG. 2 is a perspective view of the rotary fluid converter of the present invention.

FIG. 2 is a side view of the rotary fluid converter 11. The threaded connection 15 allows the rotary fluid converter 11 to be connected to the drill string as shown in FIG. 1. As can be seen in FIG. 2, the drilling fluid enters through the side orifices 8 of the rotary fluid converter 11. The shoulder 12 of the rotary fluid converter 11 is sloped as previously explained to form at least one fluid flow transition angle at other than 90° with respect to bore 14 such that the entry of the drilling fluid into the orifice 8 and bore 14 encounters a first significant decrease in turbulence when compared to the device disclosed in commonly assigned U.S. Pat. No. 5,385,407 as discussed in relation to FIGS. 4, 5, and 6.

Figure 3:
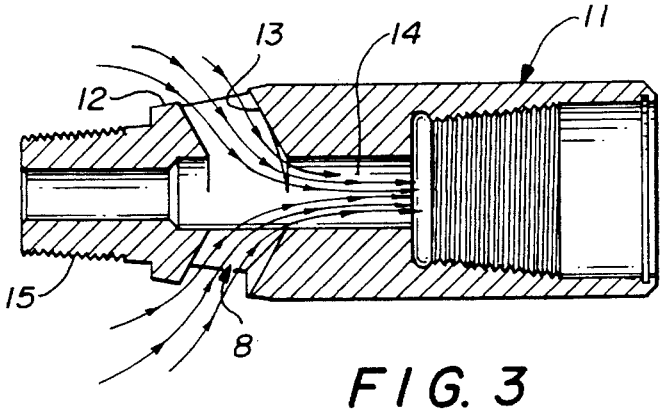
FIG. 3 is a cross-sectional view of the novel rotary fluid converter of the present invention.

FIG. 3 is a cross-sectional view of a rotary fluid converter. As can be seen clearly in FIG. 3, the orifice 8 in the rotary fluid converter 11 also has downwardly sloped top and bottom walls 13 that create additional fluid flow transition angles less than 90° with respect to bore 14 so as to cause a second significant decrease in the turbulence generated by the drilling fluid when flowing into the bore (or hollow interior) 14 of the rotary fluid converter 11.

Figure 4:
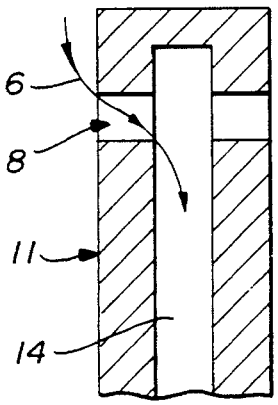
FIG. 4 PRIOR ART
FIG. 4 is a partial cross-sectional view of a prior art rotary fluid converter illustrating the turbulence caused by straight side walls and a fluid orifice at an angle of 90° to the side walls or to the bore.

Note in FIG. 4 that, in the prior art, the fluid orifice 8 is at 90° with respect to the axial length of the fluid converter 11. It can be seen that the fluid must make essentially two 90° turns to go from the exterior of the converter 11 to the interior bore 14. Clearly, great turbulence is created.

Figure 5:
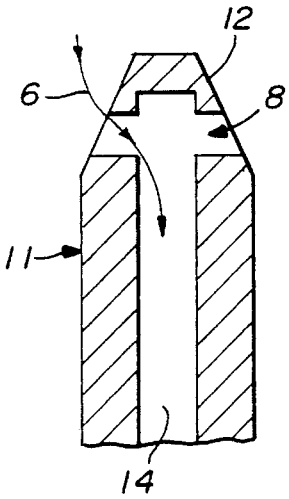
FIG. 5 is a partial cross-sectional view of a first embodiment of the present invention in which sloping shoulders are formed on the upper end thereof to reduce fluid flow turbulence.

In FIG. 5, the sloped upper portion 12 of the novel converter 11 of the present invention is shown. Note that although the interior of the fluid orifice 8 is at 90° with respect to the axial length of the fluid converter 11, the exterior of the fluid orifice 8 forms an angle with the exterior surface that is less than 90° and, thus, the fluid flow path shown by arrow 6 is more direct and less distorted from the exterior of the converter 11 to the interior bore 14. Clearly, the fluid flow transition angles have been reduced and the turbulence has been significantly decreased.

Figure 6:
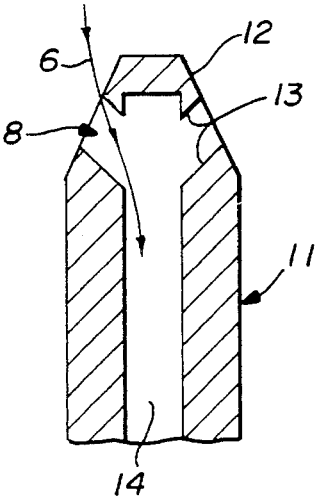
FIG. 6 is a partial cross-sectional view of a second embodiment of the present invention in which the fluid orifice connecting the external sloping shoulders and the interior bore also slope inwardly and downwardly to additionally reduce fluid turbulence and erosion and wear of the rotary fluid converter.

FIG. 6 illustrates the present invention with both the sloped upper surface 12 of the rotary fluid converter 11 as well as orifice 8 with the sloped top and bottom walls 13. It can be seen that both the interior and exterior ends of orifice 8 form angles of less than 90° with respect to the longitudinal axis of bore 14. Note how much more direct and less distorted is the fluid flow path 6 from the exterior of the rotary fluid converter 11 to the interior bore 14. Clearly, the fluid flow transition angles have been further reduced and, thus, turbulence has been significantly decreased over that shown in FIG. 5.

Thus there has been disclosed a novel rotary fluid converter that significantly reduces turbulence of the fluid flow from the exterior portion to the interior bore thereof. Thus erosion and wear of the rotary converter has also been significantly reduced and the converter does not have to be replaced as quickly as in the prior art. The turbulence is reduced first by sloping the upper walls of the rotary fluid converter in which the fluid orifice is located to cause the fluid flow path to be less distorted than in the prior art. The turbulence is further reduced by sloping the fluid orifice downwardly and inwardly in the sloping walls such that an even more direct fluid flow path is obtained thus further reducing the distorted fluid flow and causing even less turbulence.

While the invention has been described in connection with a preferred embodiment, it is not intended to limit the scope of the invention to the particular form set forth, but, on the contrary, it is intended to cover such alternatives, modifications, and equivalents as may be included within the spirit and scope of the invention as defined by the appended claims.

I claim:

1. A hollow elongated rotary fluid converter comprising:

sloping exterior shoulders at one end;

a hollow bore at the center; and at least one fluid orifice extending from the exterior sloping shoulders to the interior bore at a tangent with respect to said bore and cooperating with said sloping exterior shoulders to form fluid flow transition angles that reduce the turbulence of the fluid entering said bore through said orifice thereby reducing the erosion and wear of said fluid converter.

2. A rotary fluid converter as in claim 1 wherein said fluid orifice in the rotary fluid converter slopes inwardly and downwardly between the sloping exterior shoulder and the hollow bore to form all fluid flow transition angles less than 90° as the fluid flows from the exterior of the rotary fluid converter to the center hollow bore and thereby further reduces erosion of said rotary fluid converter.

3. A substantially cylindrical rotary fluid converter comprising:

an upper end having an exterior surface;

a longitudinally extending bore in the middle of said rotary fluid converter that has one end into which drilling fluid flows;

a downwardly sloping top shoulder on said exterior surface of said upper end of said rotary fluid converter, said downwardly sloping top shoulder being at an angle less than 90° degrees relative to the longitudinal axis of said bore; and a downwardly sloping fluid orifice extending from said downwardly sloping top shoulder to said bore, said downwardly sloping orifice entering said bore at a tangent thereto.

4. A rotary fluid converter as in claim 3 wherein said downwardly sloping fluid orifice forms fluid flow transition angles between said downwardly sloping, top shoulder and said bore, all of said formed fluid flow transition angles being less than 90° with respect to the longitudinal axis of said bore to reduce turbulence of said fluid flow.

* * * * *